US007018965B2

(12) United States Patent
Yan et al.

(10) Patent No.: US 7,018,965 B2
(45) Date of Patent: Mar. 28, 2006

(54) AQUEOUS COMPOSITIONS FOR CLEANING GAS TURBINE COMPRESSOR BLADES

(75) Inventors: Laibin Yan, Lansdale, PA (US); Bruce K. Fillipo, Hatboro, PA (US)

(73) Assignee: General Electric Company, Schenectady, NY (US)

( * ) Notice: Subject to any disclaimer, the term of this patent is extended or adjusted under 35 U.S.C. 154(b) by 55 days.

(21) Appl. No.: 10/654,041

(22) Filed: Sep. 3, 2003

(65) Prior Publication Data

US 2005/0049168 A1 Mar. 3, 2005

(51) Int. Cl.

| | |
|---|---|
| ***C11D 1/72*** | (2006.01) |
| ***C11D 3/16*** | (2006.01) |
| ***C23G 1/26*** | (2006.01) |
| ***F01D 25/00*** | (2006.01) |
| ***B08B 3/04*** | (2006.01) |

(52) U.S. Cl. ..... 510/185; 510/255; 510/258; 510/421; 510/432; 134/2; 134/20; 134/22.14; 134/22.19; 134/23; 134/32; 134/39; 134/40; 134/41; 134/42

(58) Field of Classification Search ..... 510/185, 510/255, 258, 421, 432; 134/2, 20, 22.14, 134/22.19, 23, 32, 39, 40, 41, 42
See application file for complete search history.

(56) References Cited

U.S. PATENT DOCUMENTS

| | | | | |
|---|---|---|---|---|
| 3,882,038 | A | 5/1975 | Clayton et al. | |
| 4,511,488 | A | 4/1985 | Matta | |
| 4,675,125 | A | 6/1987 | Sturwold | |
| 4,713,120 | A | 12/1987 | Hodgens, II et al. | |
| 4,808,235 | A | 2/1989 | Woodson et al. | |
| 4,834,912 | A | 5/1989 | Hodgens, II et al. | |
| 5,002,078 | A | 3/1991 | Kaes | |
| 5,076,855 | A | 12/1991 | Kaes | |
| 5,279,760 | A * | 1/1994 | Sato et al. | 510/185 |
| 5,877,133 | A * | 3/1999 | Good | 510/175 |
| 6,001,793 | A * | 12/1999 | Figdore et al. | 510/243 |
| 6,310,022 | B1 | 10/2001 | Amiran | |

FOREIGN PATENT DOCUMENTS

| | | |
|---|---|---|
| GB | 2 077 769 | 12/1981 |
| GB | 2 104 541 | 3/1983 |
| GB | 2104541 * | 3/1983 |

* cited by examiner

*Primary Examiner*—Brian P. Mruk
(74) *Attorney, Agent, or Firm*—Duane Morris LLP

(57) ABSTRACT

The present invention is directed to a gas turbine cleaner. The composition of the present invention includes a glycol alkyl ether compound, an alkoxylated surfactant with an alkyl chain length of from about 3 to 18 carbons and a metal corrosion inhibitor component.

16 Claims, No Drawings

AQUEOUS COMPOSITIONS FOR CLEANING GAS TURBINE COMPRESSOR BLADES

BACKGROUND OF THE INVENTION

1. Field of the Invention

The present invention relates to a chemical cleaning solution for gas turbine blades. In particular, the present invention relates to a cleaning composition comprising a glycol alkyl ether compound, a solvent and a metal corrosion inhibitor component.

2. Description of the Prior Art

Industrial gas turbine engines are used worldwide. An example of a gas turbine is a Mars Gas Turbine or a Taurus 70 Gas Turbine, manufactured by Solar Turbines, Inc. A Mars turbine has a 15 stage compressor and each stage is comprised of a stationary row of blades (stator blades) and a rotating row of blades. The blades are the largest at stage 1 and the smallest at stage 15. During operation, air is drawn into the compressor's divergent passage and compressed through every stage.

The stator blades direct the compressed air at each stage across its companion row of rotating blades. The air foil of the stator and rotating blades has been designed for maximum efficiency. However, as a result of continuous operation, contaminants build up on the leading edge of these air foils. Consequently, overall efficiency is lost in the compressor section. This in turn reduces the horsepower available for consumer use. The Mars turbine engine compresses approximately 90 pounds per second of air at full rated horsepower. There is only a small amount of airborne contaminants per standard cubic foot of air. However, with the massive amounts of air passing through the turbine, these contaminants are multiplied. Moreover, the air enters the turbine at room temperature and leaves the compressor at approximately 630° F. Most of the lost efficiency is across the first three or four stages, and it is very difficult to clean the blades once the contaminants have adhered to them.

Accordingly, gas turbines must be cleaned, usually monthly, to maintain operating efficiency and maximum available horsepower. There are two main ways to clean a gas turbine; one method is crank washing, and the other is on-line washing. Crank washing is the more common of the two. During cleaning, each turbine uses about 2 gallons of cleaner to clean the turbine, and an additional 1–2 gallons to clean the package. The same cleaner may also be used for general cleaning purposes in the operating plant. Accordingly, there exists a large need for a superior gas turbine cleaner.

Gas turbine crank washing is a method whereby a cleaning solution is introduced into the turbine compressor inlet of a turbine while slow cranking takes place. This slow cranking occurs cold without ignition or fuel being introduced. There are many types of turbine compressor cleaners on the market. These include Penetone® 19, by Penetone Corporation; Connect® 5000, by Conntect, Inc.; Turco® 6783 Series, by Turco Products, Inc.; ZOK® 27, by ZOK Incorporated; and Fyrewash®, by Rochem Corporation.

However, current cleaning products have several disadvantages. These disadvantages include excessive foaming, extended soaking periods, low water solubility, and residual cleaner. Current products cure some of these disadvantages; however, none have been able to cure all of these properties.

SUMMARY OF THE INVENTION

The present invention relates to a gas turbine cleaning composition comprising a mixture of (a) a glycol alkyl ether compound, (b) an alkoxylated surfactant with an alkyl chain length of from about 3 to 18 carbons and (c) a metal corrosion inhibitor component. The present invention further relates to a method of cleaning a gas turbine compressor and/or the blades thereof during power generation without significant loss of power, which comprises contacting the surfaces to be cleaned with a cleaning composition comprising a mixture of (a) a glycol alkyl ether compound, (b) an alkoxylated surfactant with an alkyl chain length of from about 3 to 18 carbons and (c) a metal corrosion inhibitor component.

DETAILED DESCRIPTION OF THE INVENTION

The present invention is directed to a gas turbine cleaner. In particular, the cleaner of the present invention is described as a composition. The composition of the present invention comprises a glycol alkyl ether compound and an alkoxylated surfactant with an alkyl chain length of from about 3 to 18 carbons. The present composition may also contain a metal corrosion inhibitor component.

The present invention is also directed to a process for cleaning a substrate comprising providing a cleaning solution according to the present invention and contacting the cleaning solution with the substrate to be cleaned.

Specifically, the present invention relates to cleaning agent compositions useful for the cleaning of gas turbine compressor blades. The aqueous cleaning solution of the present invention is applied in order to effectively remove foulants which are deposited in gas turbine compressors, as well as to effectively clean the compressor. Note that the particular fouling deposits present on gas turbine compressors depend on the environment in which they operate, and the filtration present. The deposits typically include varying amounts of moisture, soot, water-soluble constituents, insoluble dirt and corrosion products of the compressor blading material.

In a preferred embodiment, the present invention relates to a cleaning agent composition comprising: (1) a solvent component (about 1–20 weight percent) including a combination of one or more alcohol-ethylene glycols, (2) a surfactant component (about 5–25 weight percent) including one or more nonionic surfactants, and (3) a metal corrosion inhibitor component (about 1–15 weight percent) (remainder water; about 50–90 weight percent).

The solvent component includes one or more of the following: propylene glycol methyl ether, dipropylene glycol methyl ether, tripropylene glycol methyl ether, propylene glycol n-propyl ether, dipropylene glycol n-propyl ether, tripropylene glycol n-propyl ether, propylene glycol n-butyl ether, dipropylene glycol n-butyl ether, tripropylene glycol n-butyl ether, dipropylene glycol dimethyl ether, diethylene glycol ethyl ether, diethylene glycol methyl ether, diethylene glycol n-butyl ether, diethylene glycol hexyl ether, ethylene glycol propyl ether, ethylene glycol n-butyl ether, and ethylene glycol hexyl ether.

The surfactant component includes one or more of the following: nonionic ethoxylate primary and/or secondary alcohols, alkoxylated primary alcohols with propylene oxide, and/or block copolymers of propylene oxide and ethylene oxide. The alkyl chain length is preferably in the range of 3 to 18, more preferably in the range of 6 to 15. The ethylene oxide or propylene oxide materials are in the range of from about 2 to 20 moles. Examples of such types of surfactants are Neodol™, Surfonic®, Plurafac® and Pluronic® series surfactants.

The corrosion inhibitor component includes one or more of the following: N-methyloleamidoacetic acid, triethanolamine, 1,8-octanedicarboxylic acid, (((2-hydroxyethyl) imino) bis-(methylene)) bis-phosphonic acid N-oxide, ((tetrahydro-2-hydroxy-4H-1,4,2-oxaphosphorin-4-yl)methyl) phosphonic acid N-oxide, and 5-methyl-1,2,3-benzotriazole.

The pH of the cleaning composition in accordance with the present invention may be adjusted to within the range of about 6.5 to 9, and preferably within the range of 6.5 to 7.5 by the addition of one or more of ammonium hydroxide solution, triethanolamine, and diethanolamine.

Cleaning efficiency and specification tests were conducted according to MIL-PRF-85704C (Performance Specification, Cleaning Compound, Turbine Engine Gas Path, 1998). Five hundred grams of lubricating oil conforming to MIL-PRF-23699 were mixed with 50 grams of Raven® 1040 carbon black in a one liter, wide-mouth jar. The jar was placed in an oven at 240° C.±5° C. A 0.25 inch I.D. glass tube connected to a metered air supply was inserted into the mixture, with an air flow of 8.5±0.5 cubic centimeters per second. The mixture was heated at 240° C.±5° C. with aeration for 120 hours, then cooled to room temperature and mixed until homogeneous.

Test panels were 6 inches diameter by 0.020 inches thick bare stainless steel 316. Soil was uniformly applied to the panel by brush. A cleaning apparatus rotated these panels vertically at 220 rpm in front of a nozzle, perpendicular to the panel that traveled back and forth across the prescribed area nine times per minute. The nozzle tip remained 3.3±0.1 inches from the test panel through the cleaning and rinsing cycles. One thousand ml of a 20 volume percent cleaning solution was aspirated through the nozzle onto the rotating soiled panel at a rate of 100±10 ml per minute. The nozzle was connected to a 10 psig steam line. The test panel was dried and weighed, and results were used to calculate the percent cleaning efficiency of the cleaning compound.

The cleaning efficiency of each cleaning formulation is shown in Table I, below. Cleaning efficiency was measured by weight loss and visually observing the amount of soil remaining on the test panels after cleaning. The cleaning efficiency which gave approximately 100% cleaning performance had the highest cleaning power and was ranked as #1. Deionized (D.I.) water was used as reference and was ranked as #6. The performance rank was assigned according to visual appearance (clearance) of the test panels after cleaning. As shown in the Table, 15.6% C12–18 alkoxylated linear alcohols (e.g. Plurafac D-25) blended with 1% dipropylene glycol methyl ether (Arcosolv® DPM), 3% propylene glycol n-butyl ether (Dowanol™ PnB), and a mixture of corrosion inhibitors had particularly enhanced cleaning performance. Excepting Formulation 38, all of the formulations in Table I included a mixture of corrossion inhibitors (0.1–1% by weight 5-methyl-1,2,3-benzotriazole; 0.01–0.1% by weight N-methyloloeamidoacetic acid; 0.1–3% by weight triethanolamine; 0.5–2% by weight 1,8-octanedicarboxylic acid).

TABLE I

Cleaning Solution Composition and Cleaning Test

| Formulation | Wt. % Solvent Components | Wt. % Surfactant Components | % Soil Removal | Performance Ranking |
|---|---|---|---|---|
| D.I. Water | | | 96 | 6 |
| 1 | 1 Arcosolv DPM/3 Dowanol PnB | 15.6 Neodol 25-9 | 77 | 4 |
| 2 | 1 Arcosolv DPM/3 Dowanol PnB | 8 Neodol 25-9/7.6 Neodol 25-7 | 94 | 4 |
| 3 | 1 Arcosolv DPM/3 Dowanol PnB | 8 Neodol 25-9/7.6 Neodol 23-5 | 88 | 5 |
| 4 | 1 Arcosolv DPM/3 Dowanol PnB | 8 Neodol 25-9/4 Neodol 25-7/3.6 Neodol 23-5 | 92 | 4 |
| 5 | 1 Dowanol DPnM/3 Dowanol PnB | 15.6 Neodol 25-9 | 83 | 4 |
| 6 | 1 Arcosolv DPM/3 Dowanol PnB | 15.6 Surfonic L24-9 | 73 | 5 |
| 7 | 1 Arcosolv DPM/3 Dowanol PnB | 15.6 Surfonic L24-9 | 75 | 5 |
| 8 | 1 Arcosolv DPM/3 Dowanol PnB | 13.6 Neodol 25-9/1 Neodol 25-7/1 Neodol 23-5 | 98 | 3 |
| 9 | 1 Arcosolv DPM/3 Dowanol PnB | 11.6 Neodol 25-9/2 Neodol 25-7/2 Neodol 23-5 | 79 | 4 |
| 10 | 1 Arcosolv DPM/3 Dowanol PnB | 13.6 Surfonic 24-9/1 Surfonic 12-8/1 Surfanic12-6 | 91 | 4 |
| 11 | 1 Arcosolv DPM/3 Dowanol PnB | 11.6 Surfonic 24-9/2 Surfonic 12-8/2 Surfonic 12-6 | 87 | 4 |
| 12 | 1 Arcosolv DPM/5 Dowanol PnB | 15.6 Neodol 25-9 | 92 | 4 |
| 13 | 1 Arcosolv DPM/3 Dowanol PnB | 10 Neodol 25-9 | 93 | 3 |
| 14 | 1 Arcosolv DPM/3 Dowanol PnB | 15.6 Neodol 25-9 | 95 | 3 |
| 15 | 1 Arcosolv DPM/3 Dowanol PnB | 14.6 Neodol 25-9/1 Neodol 25-7 | 89 | 4 |
| 16 | 1 Arcosolv DPM/3 Dowanol PnB | 14.6 Neodol 25-9/1 Neodol 25-7 | 76 | 5 |

TABLE I-continued

Cleaning Solution Composition and Cleaning Test

| Formulation | Wt. % Solvent Components | Wt. % Surfactant Components | % Soil Removal | Performance Ranking |
|---|---|---|---|---|
| 17 | 1 Arcosolv DPM/3 Dowanol PnB | 15.6 Iconol ™ 24-9 | 88 | 4 |
| 18 | 1 Arcosolv DPM/3 Dowanol PnB | 15.6 Iconol 35-8 | 86 | 3 |
| 19 | 1 Arcosolv DPM/3 Dowanol PnB | 15.6 Macol ® LA12 | 87 | 3 |
| 20 | 1 Arcosolv DPM/3 Dowanol PnB | 15.6 Plurafac D-25 | 99 | 1 |
| 21 | 1 Arcosolv DPM/3 Dowanol PnB | 15.6 Plurafac D-25 | 100 | 1 |
| 22 | 1 Arcosolv DPM/3 Dowanol PnB/3 Butyl Cellosolve ™ | 15.6 Plurafac D-25 | 100 | 1 |
| 23 | 1 Arcosolv DPM/3 Dowanol PnB | 15.6 Plurafac D-25 | 100 | 1 |
| 24 | 1 Arcosolv DPM/3 Dowanol PnB/3 Butyl Cellosolve | 15.6 Plurafac D-25 | 100 | 1 |
| 25 | 1 Arcosolv DPM/3 Dowanol PnB | 8.6 Plurafac D-25/7.0 Plurafac B-26 | 96 | 3 |
| 26 | 1 Arcosolv DPM/3 Dowanol PnB | 15.6 Plurafac B-26 | 96 | 2 |
| 27 | 1 Arcosolv DPM/3 Dowanol PnB | 15.6 Plurafac D-25 | 100 | 1 |
| 28 | 1 Arcosolv DPM/3 Dowanol PnB | 15.6 Plurafac SL-92 | 93 | 3 |
| 29 | 1 Arcosolv DPM/3 Dowanol PnB | 8.6 Plurafac SL-92/3.5 Plurafac B-26/3.5 Plurafac D-25 | 97 | 3 |
| 30 | 1 Arcosolv DPM/3 Dowanol PnB | 15.6 Plurafac D-25 | 100 | 1 |
| 31 | 1 Arcosolv/3 Dowanol PnB | 15.6 Plurafac D-25 | 100 | 1 |
| 32 | 1 Arcosolv DPM/3 Dowanol PnB | 9.6 Plurafac D-25/6.0-Monateric ™ CA-35/2.0 Pluronic L-62 | 93 | 4 |
| 33 | 1 Arcosolv DPM/3 Dowanol PnB | 8.6 Plurafac D-25/5.0 Ethomeen ® T20/2.0 Pluronic L-62 | 98 | 4 |
| 34 | 1 Arcosolv DPM/3 Dowanol PnB | 7.8 Plurafac D-25/7.8 Surfonic L24-12/2.0 Pluronic L-62 | 91 | 4 |
| 35 | 1 Arcosolv DPM/3 Dowanol PnB/3 Butyl Cellosolve ™ | 12.6 Plurafac D-25 | 99 | 1 |
| 36 | 1 Arcosolv DPM/3 Dowanol PnB | 15.6 Plurafac B-25-5 | 100 | 1 |
| 37 | 1 Arcosolv DPM/3 Dowanol PnB | | 96 | 5 |
| 38 | | 15.6 Plurafac D-25 | 99 | 2 |
| 39 | 1 Arcosolv DPM/3 Dowanol PnB | 15.6 Surfonic JL-25X | 100 | 1 |
| 40 | 1 Arcosolv DPM/3 Dowanol PnB | 15.6 Plurafac SL-62 | 99 | 2 |
| 41 | 1 Arcosolv DPM/3 Dowanol PnB/3 Hexylene Glycol | 15.6 Plurafac D-25 | 98 | 1 |
| 42 | 1 Arcosolv DPM/3 Dowanol PnB/3 Butyl Carbitol ™ | 15.6 Plurafac D-25 | 99 | 1 |
| 43 | 1 Arcosolv DPM/3 Dowanol PnB | 15.6 Plurafac D-25 LS | 100 | 1 |

TABLE I-continued

Cleaning Solution Composition and Cleaning Test

| Formulation | Wt. % Solvent Components | Wt. % Surfactant Components | % Soil Removal | Performance Ranking |
|---|---|---|---|---|
| 44 | 1 Arcosolv DPM/3 Dowanol PnB with 40 ppm EBO | 15.6 Plurafac D-25 | 100 | 1 |

In Table I:
1. Solvent component: Arcosolv DPM = Dipropylene Glycol Methyl Ether; Dowanol PnB = Propylene Glycol n-Butyl Ether; Dowanol DPnM = Dipropylene glycol propyl ether; Butyl Cellosolve ™ = Ethylene Glycol Monobutyl Ether; Butyl Carbitol ™ = Diethylene Glycol n-Butyl Ether; Hexylene Glycol = 2-Methyl-2,4-pentanediol.
2. Corrosion inhibitor component: 5-methyl-1,2,3-benzotriazole; N-methyloleamidoacetic acid; triethanolamine; 1,8-octanedicarboxylic acid; EBO = mixture of (((2-hydroxyethyl) imino) bis-(methylene)) bis-phosphonic acid N-oxide, and ((tetrahydro-2-hydroxy-4H-1,4,2-oxaphosphorin-4-yl)methyl) phosphonic acid N-oxide.
3. Surfactant component: Neodol 23-5: C12–11 ethoxylate primary alcohol with 5 mole EO units; Neodol 25-7: C12–15 ethoxylate primary alcohol with 7 mole EO units; Neodol 25-9: ethoxylate primary alcohol with 9 mole EO units; Surfonic L12-6: POE (6) C10–12 alkyl; Surfonic L12-8: POE (8) C10–12 alkyl; Surfonic L24-9: POE (9) C12–14 Alkyl; Surfonic JL-25X: C12–18 ethoxylated, propoxylated alcohols; Macol L12: Lauryl alcohol ethoxylate; Iconol 24-9: C12–16 ethoxyl alcohols; Iconol 35-8: C12–15 branched alcohols; molecular weight 580; Plurafac B25-5: C12–15 alkoxylated linear alcohols, molecular weight 810; Plurafac B26: C12–15 alkoxylated linear alcohols, molecular weight 1030; Plurafac D25: C12–18 alkoxylated linear alcohols, molecular weight 930; Plurafac SL-62: C6–10 alkoxylated linear alcohol, molecular weight 840; Plurafac SL-92: C6–10 alkoxylated linear alcohol, molecular weight 700.

In order to prevent any aqueous corrosion or stress corrosion of compressor materials, and to prevent hot corrosion in the turbine, the components of the cleaning solution are preferably of high purity and balanced with the corrosion inhibitors. The residue or ash content of the cleaning solution should preferably not exceed about 0.01%; therefore, all the components, especially the surfactant component, should be a grade of high purity, low salt for a gas turbine cleaning application purpose.

Preferably, total alkaline metals should be less than about 25 ppm, magnesium and calcium should be less than about 5 ppm, tin and copper should be less than about 10 ppm, sulfur should be less than about 50 ppm, chlorine should be less than about 40 ppm, and vanadium and lead less than about 0.1 ppm.

While the present invention has been described with respect to particular embodiments thereof, it is apparent that numerous other forms and modifications of the invention will be obvious to those skilled in the art. The appended claims and the present invention generally should be construed to cover all such obvious forms and modifications which are within the true spirit and scope of the present invention.

What is claimed is:

1. A gas turbine cleaning composition comprising a mixture of (a) a glycol alkyl ether compound, (b) an alkoxylated surfactant with an alkyl chain length of from about 3 to 18 carbons and (c) a metal corrosion inhibitor component, wherein the mixture has an alkaline metal content less than about 25 ppm, said metal corrosion inhibitor component selected from the group consisting of N-methyloleamidoacetic acid, 1,8-octanedicarboxylic acid, (((2-hydroxyethyl) imino) bis-(methylene)) bis-phosphonic acid N-oxide, ((tetrahydro-2-hydroxy-4H-1,4,2-oxaphosphorin-4-yl)methyl) phosphonic acid N-oxide, and mixtures thereof with triethanolamine.

2. The composition as recited in claim 1, wherein said glycol alkyl ether compound is selected from the group consisting of propylene glycol methyl ether, dipropylene glycol methyl ether, tripropylene glycol methyl ether, propylene glycol n-propyl ether, dipropylene glycol n-propyl ether, tripropylene glycol n-propyl ether, propylene glycol n-butyl ether, dipropylene glycol n-butyl ether, tripropylene glycol n-butyl ether, dipropylene glycol dimethyl ether, diethylene glycol ethyl ether, diethylene glycol methyl ether, diethylene glycol n-butyl ether, diethylene glycol hexyl ether, ethylene glycol propyl ether, ethylene glycol n-butyl ether, and ethylene glycol hexyl ether, and mixtures thereof.

3. The composition as recited in claim 1, wherein said alkoxylated surfactant is selected from the group consisting of nonionic ethoxylate primary or secondary alcohols, alkoxylated primary alcohols with propylene oxide, and block copolymers of propylene oxide and ethylene oxide, and mixtures thereof.

4. The composition as recited in claim 1, wherein said alkoxylated surfactant has an alkyl chain length of from about 6 to 15 carbons.

5. The composition as recited in claim 1, wherein said alkoxylated surfactant is nonionic.

6. The composition as recited in claim 1, wherein the pH of the mixture is from about 6.5–9.

7. The composition as recited in claim 6, wherein the pH of the mixture is from about 6.5–7.5.

8. The composition as recited in claim 1, wherein the mixture has a residue content less than about 0.01%.

9. A method of cleaning a gas turbine compressor and the blades thereof during power generation without significant loss of power, which comprises contacting the surfaces to be cleaned with a cleaning composition comprising a mixture of (a) a glycol alkyl ether compound, (b) an alkoxylated surfactant with an alkyl chain length of from about 3 to 18 carbons and (c) a metal corrosion inhibitor component, wherein the mixture has an alkaline metal content less than about 25 ppm, said metal corrosion inhibitor component selected from the group consisting of N-methyloleamidoacetic acid, 1.8-octanedicarboxylic acid, (((2-hydroxyethyl) imino) bis-(methylene)) bis-phosphonic acid N-oxide, ((tetrahydro-2-hydroxy-4H-1,4,2-oxaphosphorin-4-yl)methyl) phosphonic acid N-oxide, and mixtures thereof with triethanolamine.

10. The method as recited in claim 9, wherein said glycol alkyl ether compound is selected from the group consisting of propylene glycol methyl ether, dipropylene glycol methyl ether, tripropylene glycol methyl ether, propylene glycol n-propyl ether, dipropylene glycol n-propyl ether, tripropylene glycol n-propyl ether, propylene glycol n-butyl ether, dipropylene glycol n-butyl ether, tripropylene glycol n-butyl ether, dipropylene glycol dimethyl ether, diethylene glycol ethyl ether, diethylene glycol methyl ether, diethylene glycol n-butyl ether, diethylene glycol hexyl ether, ethylene glycol propyl ether, ethylene glycol n-butyl ether, and ethylene glycol hexyl ether, and mixtures thereof.

11. The method as recited in claim 9, wherein said alkoxylated surfactant is selected from the group consisting of nonionic ethoxylate primary or secondary alcohols, alkoxylated primary alcohols with propylene oxide, and block copolymers of propylene oxide and ethylene oxide, and mixtures thereof.

12. The method as recited in claim 9, wherein said alkoxylated surfactant has an alkyl chain length of from about 6 to 15 carbons.

13. The method as recited in claim 9, wherein said alkoxylated surfactant is nonionic.

14. The method as recited in claim 9, wherein the pH of the mixture is from about 6.5–9.

15. The method as recited in claim 14, wherein the pH of the mixture is from about6.5–7.5.

16. The method as recited in claim 9, wherein the mixture has a residue content less than about 0.01%.

* * * * *